United States Patent [19]

Kesten et al.

[11] 4,035,107

[45] July 12, 1977

[54] PUMP SYSTEM FOR HIGH PRESSURE ABRASIVE LIQUIDS

[75] Inventors: Stanley Frank Kesten, Glendale; Miroslav Liska, Los Angeles, both of Calif.

[73] Assignee: Durotech Co., Burbank, Calif.

[21] Appl. No.: 723,459

[22] Filed: Sept. 15, 1976

Related U.S. Application Data

[63] Continuation of Ser. No. 565,685, April 7, 1975, abandoned.

[51] Int. Cl.[2] ..... F04B 49/00; F04B 43/04; F04B 45/04; F01B 19/02

[52] U.S. Cl. ..... 417/310; 417/311; 417/413; 92/96; 92/98 R; 92/99; 92/102; 92/103 R

[58] Field of Search ..... 92/99–103, 92/98 R, 96; 417/310, 311, 413

[56] References Cited

U.S. PATENT DOCUMENTS

| | | | |
|---|---|---|---|
| 3,093,086 | 6/1973 | Altoz et al. | 92/102 |
| 3,229,592 | 1/1966 | Puster | 92/100 |
| 3,298,285 | 1/1967 | Webb | 92/98 R |
| 3,416,461 | 12/1968 | McFarland | 92/99 |
| 3,572,218 | 3/1971 | Gumtow | 92/99 |
| 3,626,814 | 12/1971 | Andersson | 92/103 R |
| 3,715,174 | 2/1973 | Davis et al. | 417/311 |
| 3,848,517 | 11/1974 | Hawke | 92/102 |

FOREIGN PATENT DOCUMENTS

| | | | |
|---|---|---|---|
| 1,926,313 | 11/1970 | Germany | 417/413 |

*Primary Examiner*—John J. Vrablik
*Assistant Examiner*—G. P. LaPointe
*Attorney, Agent, or Firm*—Huebner & Worrel

[57] ABSTRACT

The present invention relates to constant stroke reciprocating piston pump with mechanically driven diaphragm coupler, including combination of adjustable pressure control means and priming valve for handling abrasive liquids such as paint, and texture.

9 Claims, 8 Drawing Figures

PUMP SYSTEM FOR HIGH PRESSURE ABRASIVE LIQUIDS

This is a continuation, of application Ser. No. 565,685, filed Apr. 7, 1975 now abandoned.

DESCRIPTION OF THE PRIOR ART

In order to obtain commercially acceptable life expectancy of conventional pressure relief valves used in abrasive fluids such as paint during throttled or standby condition, it would require extremely expensive, practically almost impossible alignment of 0.0001 inch in 4 inches, besides necessity of highly resistant material to abrasion such as tungsten carbide, otherwise uneven valve wear and leakage leading to self-destruction of valve will occur within several hours, depending on abrasivity and velocity of pumping liquid. Present invention solved above mentioned problem in its design as described further.

Every manufacturer of pumps is trying to eliminate cavitation in the suction line in order to avoid vaporization and condensation which is leading to rapid erosion and corrosion of pump parts.

The prior art pump such as Schlosser U.S. Pat. No. 3254845 is utilizing such cavitation of prime mover to control flow of driven (secondary) liquid in throttled or standby condition at the expense of erosion and corrosion of the pump parts. Such pumps use oil as a driving fluid and its compressibility causes a substantial horsepower loss.

BRIEF STATEMENT OF THE INVENTION

It is a prime concern of this invention to provide a small, portable, light weight, low cost spray pump with minimum of moving parts and highest possible degree of dependability for high pressure spraying of abrasive liquids such as paint.

In order to obtain the highest possible efficiency in input and output horsepower, it is an object of the invention to eliminate hydraulic fluid as a prime mover and to utilize an improved mechanically driven diaphragm for airless spraying of abrasive liquids such as paint.

The present invention utilizes a new and improved pressure control device capable of withstanding high velocity of abrasive fluids with minimum wear. Insignificant increase in temperature during standby condition of the unit has been eliminated by efficient aircooling system (fan, area of aluminum housing, and fins).

It is another object of the invention to provide a pump, as referred to above, in which all of the valves are easily accessible from one face of the pump.

BRIEF DESCRIPTION OF THE DRAWINGS

Referring to the accompanying drawings, which are for illustrative purposes.

DETAILED DESCRIPTION OF THE INVENTION

Figure 1:
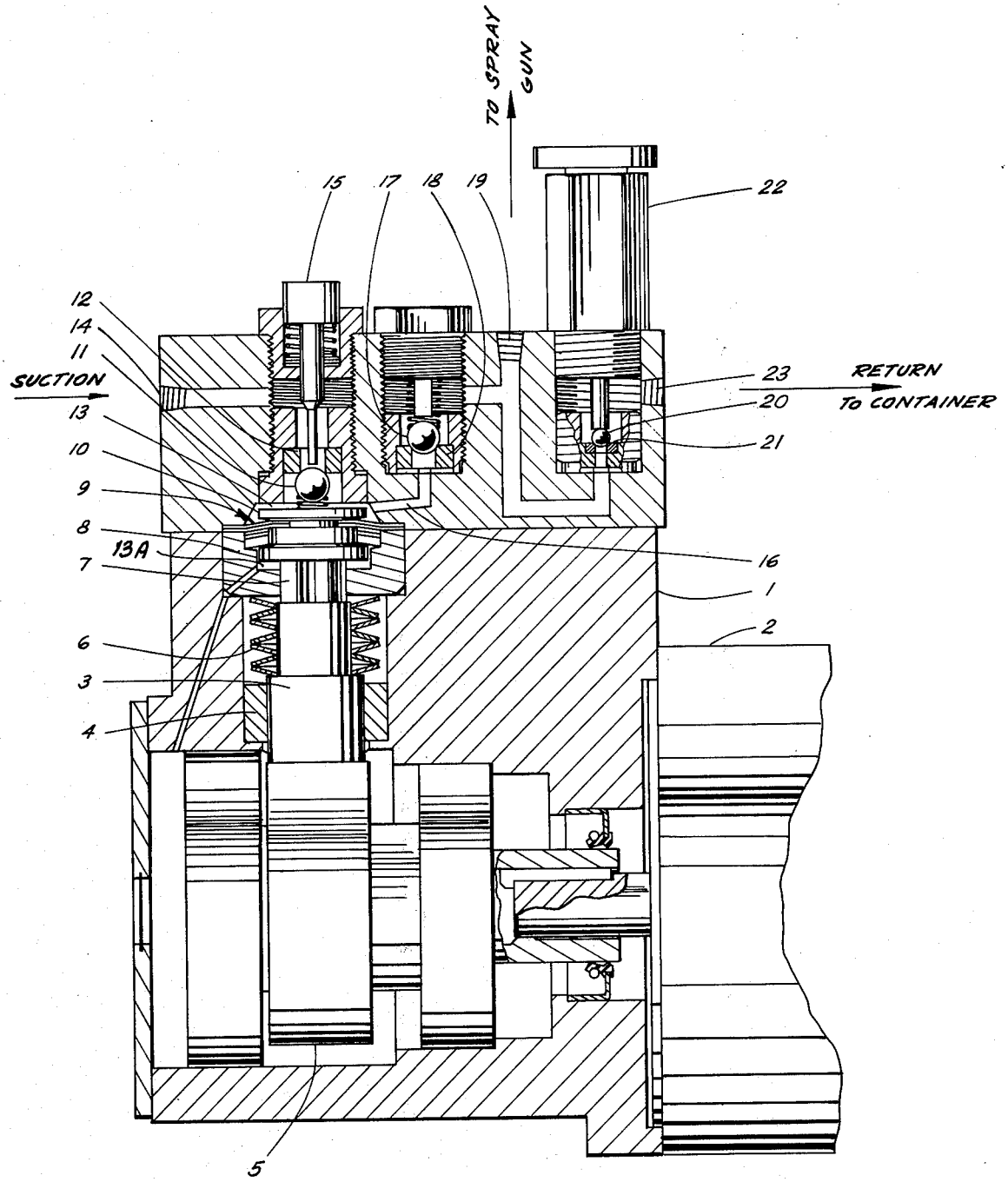
FIG. 1 is a cross-sectional elevational view of a pump illustrating the invention.

Referring to FIG. 1, a portable pump housing 1 is directly coupled to electric motor 2. During the suction stroke a reciprocating member or piston 3, quided in bronze bushing 4, is following eccentric 5 due to springs 6. Upper part 7 of the piston is guided in diaphragm support 8. Flexing of the diaphragm generally designated as 9, secured by bolt 10, is creating in pumping chamber 13*a* negative pressure which in turn is unseating suction ball 11 from its seat 12, and paint to the pumped starts filling the pumping chamber 13 through suction port 14 from paint container. During the initial suction period spring loaded pin 15 is used for manual unseating of the suction ball 11 if necessary. In following pressure stroke piston 3 is moved upwardly by eccentric 5, and by flexing of the diaphragm 9 into pumping chamber 13 and away from diaphragm coupler chamber 13A, paint is being displaced through small bore 16, unseating discharge ball 17 from its seat 18 into the spray gun through discharge port 19. When spraying is stopped, pressure build-up in hose (accumulator) shall unseat the unloading ball 20 from its seat 21 of unloading valve 22 as described in FIG. 5, and paint is returned through the unloading port 23 to the paint container.

Figure 2:
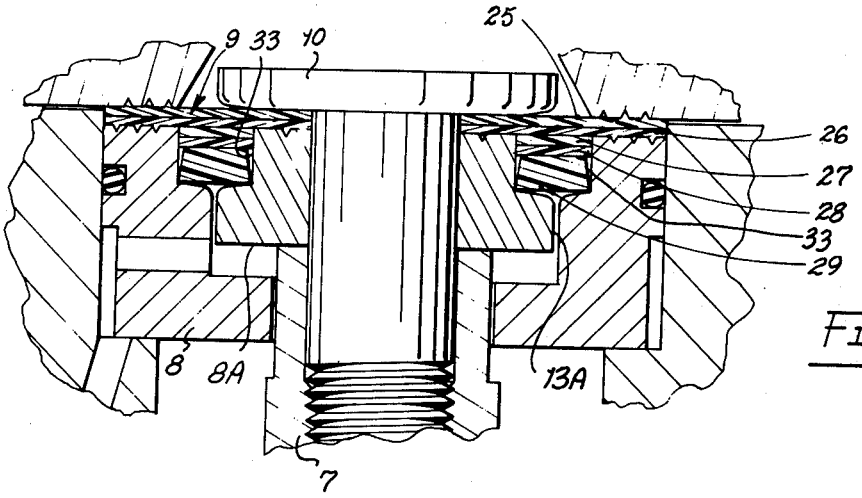
FIG. 2 is an enlarged fragmentary view of the pump diaphragm and its supporting structure shown in FIG. 1.

Detail of the diaphragm coupler or actuation chamber 13A is shown in FIG. 2. The diaphragm coupler comprises of solvent resistant plastic diaphragm 25, 1 millimeter thick, with relatively low modulus of elasticity, and of supporting diaphragm 26 of the same thickness with molybdenum disulfide or equivalent material with low coefficient of friction. A pressure-load distributing washer 27 is 0.031 inch thick is position above a second washer 28, also 0.031 inch thick, made of material with low coefficient of friction such as Teflon.

Figure 3:
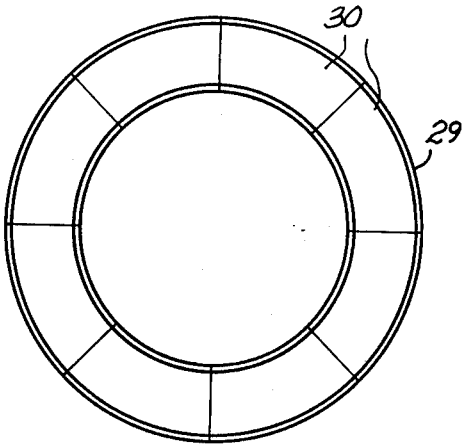
FIG. 3 is a plan view of a segmental ring which supports the diaphragm.

One of the most important components of the diaphragm coupler is a segmented ring, diaphragm support 29, formed of annularly positioned, substantially or actually contacting, freely movable in reciprocation, segments 30, shown in FIG. 3, supported by diaphragm support 8 and annular diaphragm support 8A. The support 8A is secured against the diaphragm by the bolt 10 tightened in the upper piston part 7. The washers and ring are positioned in an annular groove 33 formed by annular shoulders of supports 8 and 8A, and are in substantial radial contact with the circumferential walls of the groove. The segments are tapered on their circumferential edges to easily pivot in the groove 33. Both the washers and segments have flat upper and lower contacting surfaces to avoid cutting each other and the diaphragm. The washers are also freely movable in reciprocation in the groove, and the segments 30 have a low coefficient of friction and a high modulus of elasticity.

Figure 4:
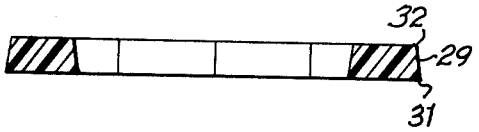
FIG. 4 is a cross-sectional view of the ring shown in FIG. 3.

FIG. 4 shows a cross section through supporting segments for pump stroke of 0.062 inch. Deviation from the vertical line of outside edge 31 and inside edge 32 is approximately 8°.

Figure 5:
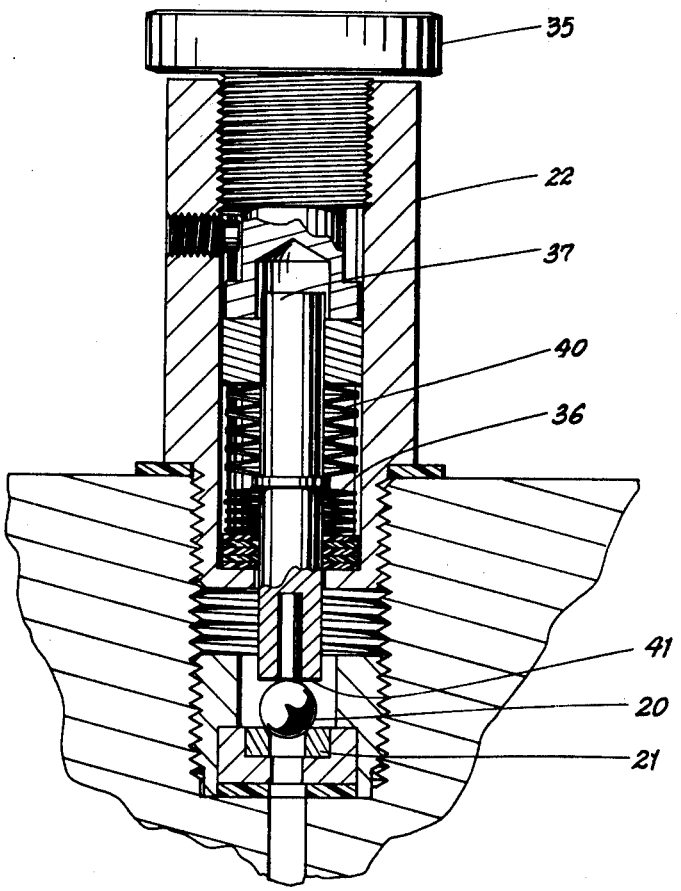
FIG. 5 is an enlarged cross-sectional view of a control valve of the pump.
Figure 6:
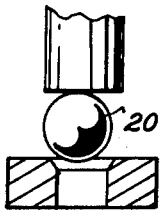
FIG. 6 is a view of the control valve in the open position.
Figure 7:
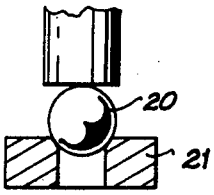
FIG. 7 is a view of the control valve in the preset position.
Figure 8:
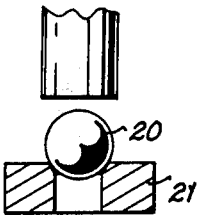
FIG. 8 is a view of the control valve in the unset condition.

Referring now to FIG. 5, cross-sectional details of the pump adjustable pressure control valve in combination with priming valve 22 for abrasive liquids such as paint is shown. When turning control knob 35 counterwise or outwardly, lower set of springs 36 shall lift control pin 37 as shown in FIG. 8. Ball 20 is now free to be lifted from its seat 21 by pressure of air during initial suction period as shown in FIG. 6. When pump is free of air bubbles and liquid starts circulating through by-passing system, then by turning control knob 35 clockwise or inwardly, upper set of springs 40 will move control pin 37 downwardly to be seated on ball 20, and further turning of control knob 35 clockwise will close by-passing and shall preset pressure as shown in FIG. 7.

Major components of combination control valve are tungsten carbide ball 20 and seat 21. Control pin 37 is made of hardened stainless steel or preferably of tungsten carbide to resist deformation under load. Contact area 41 of control pin 37 is perpendicular to the vertical centerline of tungsten carbide seat 21 which is very important for free floating of tungsten carbide ball 20. When large coarse abrasive particles of pumped liquid are present, for instance 0.0005 inch larger then clearance created by flow during recirculation, tungsten carbide ball 20 is avoiding its abrasion and abrasion of the seat 21 by free floating horizontal movement. This feature extends life of tungsten carbide ball 20 and seat 21 in abrasive liquid.

The invention and its attendant advantages will be understood from the foregoing description and it will be apparent that various changes may be made in the form, construction and arrangements of the parts of the invention without departing from the spirit and scope thereof or sacrificing its material advantages, the arrangements hereinbefore described being merely by way of example. We do not wish to be restricted to the specific form shown or uses mentioned except as defined in the accompanying claims, wherein various portions have been separated for clarity of reading and not for emphasis.

We claim as our invention

1. In a high pressure, high velocity diaphragm pump having a housing, a cavity within the housing, a flexible diaphragm dividing said cavity into two separate chambers, said diaphragm being sealingly secured and supported in the housing along a peripheral portion of the diaphragm, one of said chambers being a pumping chamber having an inlet and an outlet for the fluid being pumped, the other of said chambers being a dry diaphragm actuation chamber, said diaphragm being adapted to be rapidly flexedly reciprocated to create a suction in the pumping chamber when flexed away from the pumping chamber and to create a high discharge pressure in the pumping chamber when flexed toward the pumping chamber, means connected to the pumping chamber to permit fluid flow thereinto when the suction is created, means connected to the pumping chamber to permit fluid flow therefrom when the discharge pressure is created, the improvement comprising means connected to and associated with said diaphragm within the dry actuation chamber, said means connected and associated including:

a driving reciprocating member being adapted to flex a central flexible portion of the diaphragm, said reciprocating member being connected to said flexible central portion so as to support said portion at the connection, pivotal ring members being adapted to be pivoted by said reciprocating member and to support the flexible portion of the diaphragm between its peripheral portion and said connection, and one or more thin washers extending between the diaphragm and the pivotal members to distribute the load on the pivotal members to the diaphragm in support of the diaphragm.

2. The invention according to claim 1 in which:

said pivotal ring members are a segmented ring, the segments being in substantial annular contact.

3. The invention according to claim 1 in which:

said pivotal ring members are a segmented ring, the segments being in annular contact.

4. The invention according to claim 3 in which:

the ring segments have a low coefficient of friction and a high modulus of elasticity.

5. The invention according to claim 1 in which:

said pivotal ring members are a segmented ring, the segments and the washers having flat upper and lower surfaces.

6. The invention according to claim 4 in which:

said diaphragm is comprised of a first and second sheet in continuous contact with each other, the first sheet having relatively low modulus of elasticity, the second sheet having a relatively low coefficient of friction, said second sheet being in contact with said washer.

7. The invention according to claim 5 in which:

said ring segments are in an annular groove in said actuation chamber and are supported on a radially inward bottom portion of the segments by an annular shoulder extending radially outwardly from said reciprocating member, said ring segments being supported on a radially outward bottom portion thereof by a fixed annular shoulder within said actuation chamber in general radial alignment with the shoulder extending from said reciprocating member, the segments being closely fitted within said groove and being tapered upwardly on their circumferential edges to easily pivot within said groove.

8. The invention according to claim 7 in which:

said washer is in said annular groove in substantial radial contact inwardly with said reciprocating member and in substantial radial contact outwardly with an actuation chamber wall forming said groove above said fixed annular shoulder.

9. The invention according to claim 1 in which:

said means connected and associated are further adapted by flexing the diaphragm to create a positive fluid displacement within the pumping chamber directly proportional to the amount of reciprocating movement of the reciprocating member.

* * * * *